US011299310B2

(12) United States Patent
Pegoraro et al.

(10) Patent No.: US 11,299,310 B2
(45) Date of Patent: Apr. 12, 2022

(54) APPARATUS FOR EMPTYING BAGS CONTAINING LOOSE MATERIAL

(71) Applicant: Main Tech S.r.l., Pianiga (IT)

(72) Inventors: Renato Pegoraro, Cadoneghe (IT); Stefano Rostin, San Giorgio delle Pertiche (IT)

(73) Assignee: MAIN TECH S.R.L., Pianiga (IT)

( * ) Notice: Subject to any disclaimer, the term of this patent is extended or adjusted under 35 U.S.C. 154(b) by 0 days.

(21) Appl. No.: 16/760,944

(22) PCT Filed: Oct. 30, 2018

(86) PCT No.: PCT/IB2018/058496

§ 371 (c)(1),
(2) Date: May 1, 2020

(87) PCT Pub. No.: WO2019/087068

PCT Pub. Date: May 9, 2019

(65) Prior Publication Data

US 2020/0299017 A1 Sep. 24, 2020

(30) Foreign Application Priority Data

Nov. 3, 2017 (IT) ..... 102017000125470

(51) Int. Cl.
*B65B 69/00* (2006.01)
*B06B 1/16* (2006.01)

(52) U.S. Cl.
CPC ..... *B65B 69/0008* (2013.01); *B06B 1/161* (2013.01); *B65B 69/0033* (2013.01)

(58) Field of Classification Search
CPC ..... B65B 69/0033; B65B 69/0008; B65B 2210/10; B06B 1/10; B06B 1/161;
(Continued)

(56) References Cited

U.S. PATENT DOCUMENTS 2,396,954 A * 3/1946 Murray ..... B07B 1/12 209/260
2,676,915 A * 4/1954 Marie ..... C10B 37/04 202/262

(Continued)

FOREIGN PATENT DOCUMENTS

EP 1838582 1/2015
FR 2483882 12/1981

(Continued)

OTHER PUBLICATIONS

International Search Report and Written Opinion dated Jan. 24, 2019 for PCT Application PCT/IB2018/058496.

*Primary Examiner* — Glenn F Myers
(74) *Attorney, Agent, or Firm* — Stradley Ronon Stevens and Young, LLP

(57) ABSTRACT

An apparatus for emptying bags containing loose material. The apparatus comprises a cutting member for cutting the bags and a support grid including a row of rods arranged downstream of the cutting member and onto which the bags are carried once they have been cut. The rods are associated with a motovibrator designed to cause the rods to vibrate, facilitating the emptying of the bags. Furthermore, a resilient spacer is interposed between each pair of adjacent rods.

20 Claims, 2 Drawing Sheets

(58) Field of Classification Search
CPC . B62D 1/14; B62D 7/06; B65G 47/90; B65G 65/32; B65G 65/34
USPC ..... 414/412
See application file for complete search history.

(56) References Cited

U.S. PATENT DOCUMENTS

| | | | | |
|---|---|---|---|---|
| 5,762,463 | A * | 6/1998 | Bielagus | B65B 69/0008 414/412 |
| 8,197,174 | B1 * | 6/2012 | Caron | B65B 69/0033 414/412 |
| 2017/0158369 | A1 * | 6/2017 | Dopfer | B65B 69/0008 |

FOREIGN PATENT DOCUMENTS

| | | | | |
|---|---|---|---|---|
| FR | 2578809 | | 9/1986 | |
| JP | 04311439 | A * | 11/1992 | B65B 69/0008 |

* cited by examiner

APPARATUS FOR EMPTYING BAGS CONTAINING LOOSE MATERIAL

CROSS REFERENCE TO RELATED APPLICATIONS

This application is a U.S. National Phase filing of International Patent Application No. PCT/IB2018/058496 filed on Oct. 30, 2018, which claims the priority of Italian Patent Application No. 102017000125470 filed on Nov. 3, 2017. The disclosures of these applications are hereby incorporated by reference in their entirety.

DESCRIPTION

Technical Field

This invention relates to an apparatus for emptying bags containing loose material.

Technological Background

The invention is particularly and preferably applied in industrial plastics material transformation, where the material to be processed is supplied in the form of granules, duly packaged into bags, which are in turn stacked in an orderly manner onto a loading base, typically a pallet, to facilitate their storage and transport.

The bags of material must therefore be unloaded from the pallet and emptied of their contents into hoppers that supply the transformation machines of the plastic material.

In order to automate these operations, apparatuses have been developed, commonly referred to as "bag-emptiers," which comprise an unloading unit, including a device designed to hook a plurality of bags present on the pallet, and a subsequent emptying unit, designed to cut the bags supplied by the unloading device, thereby causing the material contained therein to be collected into a hopper.

One of the most important requirements of this type of apparatus is to ensure that bags are emptied as completely as possible.

One known example of a bag-emptying apparatus is described in EP 1838582. The apparatus described in that document comprises a plurality of parallel blades used to slit the bags carried in a direction of advance by a specific conveyor trolley, followed by a plurality of rods parallel to the advancement direction in which the bags slit by the blades are supported. In a bid to ensure the complete emptying of the slit bags. EP 1838582 proposes shaking the rods laterally to the advancement direction or shaking the slit bags directly using the conveyor trolley.

SUMMARY OF THE INVENTION

The problem at the base of the invention is to make available an apparatus for emptying bags containing loose material that has been structurally and functionally designed to empty the loose material as completely as possible from the bags.

Under the scope of this problem, the invention aims to provide an apparatus that is simple to develop and easy to use.

This problem is solved by this invention by providing an apparatus made in accordance with the embodiments or aspects disclosed below.

In a first aspect thereof, therefore, the invention relates to an apparatus for emptying bags containing loose material, designed or configured to cut the bags and empty them of the loose material they contain.

Preferably, the apparatus includes a cutting member designed or configured to cut the bags.

Preferably, the apparatus also includes a support grid onto which the bags are taken, once cut.

Preferably, the support grid is positioned downstream of the cutting member with respect to an advancement direction of the bags.

Preferably, the support grid comprises a row of rods.

Preferably, the rods are associated with a motovibrator arranged to cause the rods to vibrate, thereby facilitating the emptying of the bags.

Preferably, a resilient spacer is positioned between each pair of adjacent rods.

Thanks to these characteristics, the apparatus according to the invention makes it possible to ensure highly effective, consistent emptying of the bags, recovering much of the material that would otherwise tend to remain amongst the shreds of the slit bags.

This invention may also have one or more of the following preferred characteristics.

Preferably, the apparatus comprises a movement device designed or configured to move the bags along an advancement direction towards the cutting member and thereafter towards the support grid.

The cutting member and support grid are part of an emptying unit that, in a preferred form, is positioned immediately downstream of an unloading unit designed or configured to unload the bags from a loading base, for example a pallet, or from any storage station, and carry them to the emptying unit, using the movement device.

The unloading unit can be developed in any appropriate manner, as can the bag movement device, which, in one embodiment, comprises a plurality of hooks to hook the bags from above and move them along the advancement direction.

In a preferred form, the cutting member comprises a plurality of blades oriented parallel to the advancement direction. Preferably, the blades are circular and rotate around a rotating axis that is perpendicular to the advancement direction. Also preferably, the blades are coaxial and arranged alongside each other, at regular intervals.

Preferably, the rods of the support grid extend substantially along the advancement direction and, more preferably, are parallel to each other.

Preferably, the rods are spaced with a regular pitch, and more preferably with a pitch similar to that envisaged between the blades of the cutting member. In one embodiment, the rods are substantially aligned with the blades.

Preferably, the rods are free at least at one end region and, more preferably, both opposite end regions are free.

Preferably, the vibrations are transmitted to the rods from the motovibrator at their median region or zone.

This means that the vibrations induced on each rod are transformed into flexure of the rods which becomes more extensive at the longitudinal ends.

Preferably, the rods are strictly tightened at their median zone.

More specifically, there are one or more support bars (for example, two) that engage the rods in their median zone, leaving the opposed end regions free to oscillate.

The median zone represents for example approximately 20% of the longitudinal extent of the rods.

Preferably, the spacers are threaded onto one or more support bars, alternating with the rods and, more preferably, the rods and spacers are tightened together on the one or more support bars, by appropriate clamping elements positioned at the ends of the one or more support bars.

Preferably, the ends of one or more support bars are fixed to respective heads, external to the rods, associated with the motovibrator.

The motovibrator is, preferably, a 3,000 rpm eccentric mass motor.

More specifically, the motovibrator is fixed, for example by brackets, onto crosspieces, in turn fastened to the heads, so that the vibration movement of the motovibrator is conveyed directly to the heads.

The vibrations are therefore conveyed to the median zone of the rods by the heads and the support bars and, at least partly, also by the spacers.

In a preferred embodiment, the rotation axis of the motovibrator is substantially parallel to the longitudinal direction of the rods.

In an alternative embodiment, the rotation axis of the motovibrator is substantially perpendicular to the longitudinal direction of the rods.

The support grid is for example fixed to the frame of the emptying unit by anti-vibration elements.

Preferably, these anti-vibration elements are inter-positioned between the heads and frame of the emptying unit.

In a preferred embodiment, the rods comprise a portion which is inclined with respect to the advancement direction, between two portions that are instead substantially parallel thereto.

In this way, the rods define a trajectory with lateral spacing that tends to upturn the shreds of the slit bags, while they are guided between the rods.

Preferably, the inclined portion extends for between 10 and 20 cm, and is provided at a distance of between 5 and 20 cm from the cutting member.

Preferably, the inclination with respect to the advancement direction of the inclined portion is between 10° and 45°, more preferably between 20° and 30°.

The apparatus also comprises a pressurized gas circuit designed to blow a jet of gas towards the slit bags, to facilitate their emptying.

Preferably, the pressurized gas circuit has at least one nozzle downstream of the cutting member.

In this manner, the jets of gas emitted from the nozzle shake the shreds of the slit bags, causing any material that may have become caught in the folds and bags formed by them, to fall.

Moreover, the gas jets are easily and extensively adjustable both in terms of flow and direction, making it possible to adjust the emptying phase to the type of loose material contained in the bags and to the degree of emptying desired.

In a preferred form, the pressurized gas circuit is equipped with a plurality of nozzles, arranged in suitable positions with respect to the path taken by the slit bags.

Preferably, the nozzles are arranged on opposing sides to the bags with respect to the advancement direction, for example on the opposing sides of the support grid.

This configuration ensures a more effective shaking of the shreds of the slit bags.

Moreover, for example, the nozzles are directed perpendicular to the advancement direction.

The gas can be emitted by the nozzles continuously or intermittently.

Most preferably, the gas is emitted in an alternated manner on the two opposing sides, so as to shake the shreds of bags, first from one side and then from the other side.

The flow, direction, and duration of each jet of gas can be suitably adjusted.

In one embodiment, the gas emitted from the circuit is air.

In a preferred embodiment, the emptying unit comprises a discharge hopper downstream of the cutting member, below the support grid, designed or configured to collect the material unloaded from the bags.

It is to be understood that both the foregoing general description and the following detailed description are exemplary, but are not restrictive, of the disclosure.

BRIEF DESCRIPTION OF THE DRAWINGS

The characteristics and advantages of the invention will become clearer from the detailed description of preferred embodiments, provided by way of non-limiting example with reference to the appended drawings, in which.

DETAILED DESCRIPTION OF THE INVENTION

Figure 1:
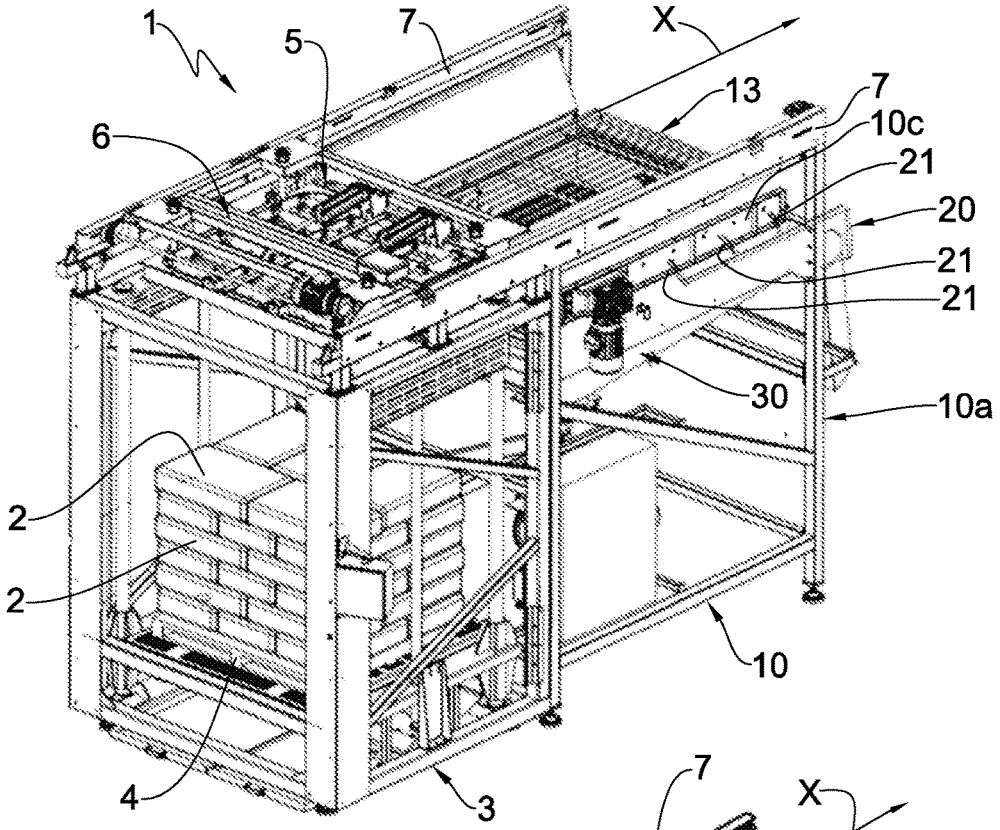
FIG. 1 is a schematic view of an apparatus for emptying bags containing loose material developed in accordance with this invention.
Figure 2:
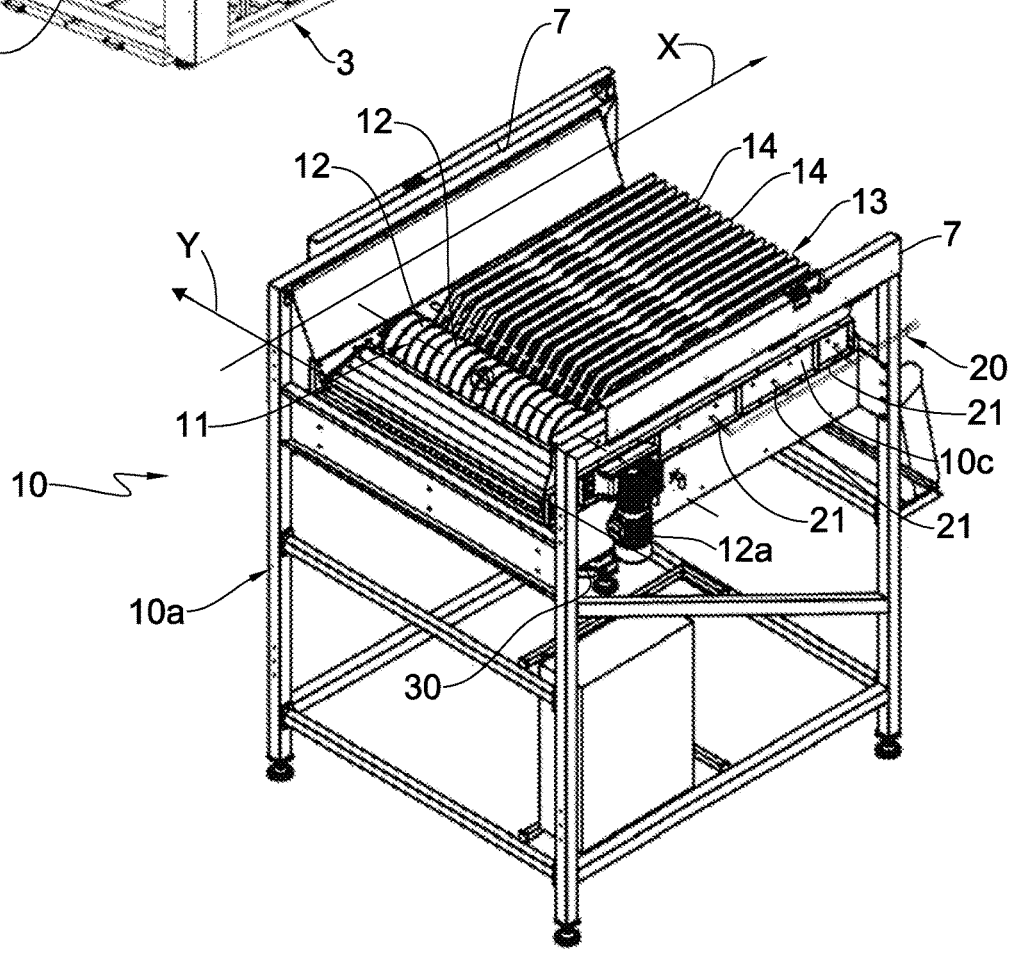
FIG. 2 is a schematic view of an emptying unit of the apparatus shown in FIG. 1.
Figure 3:
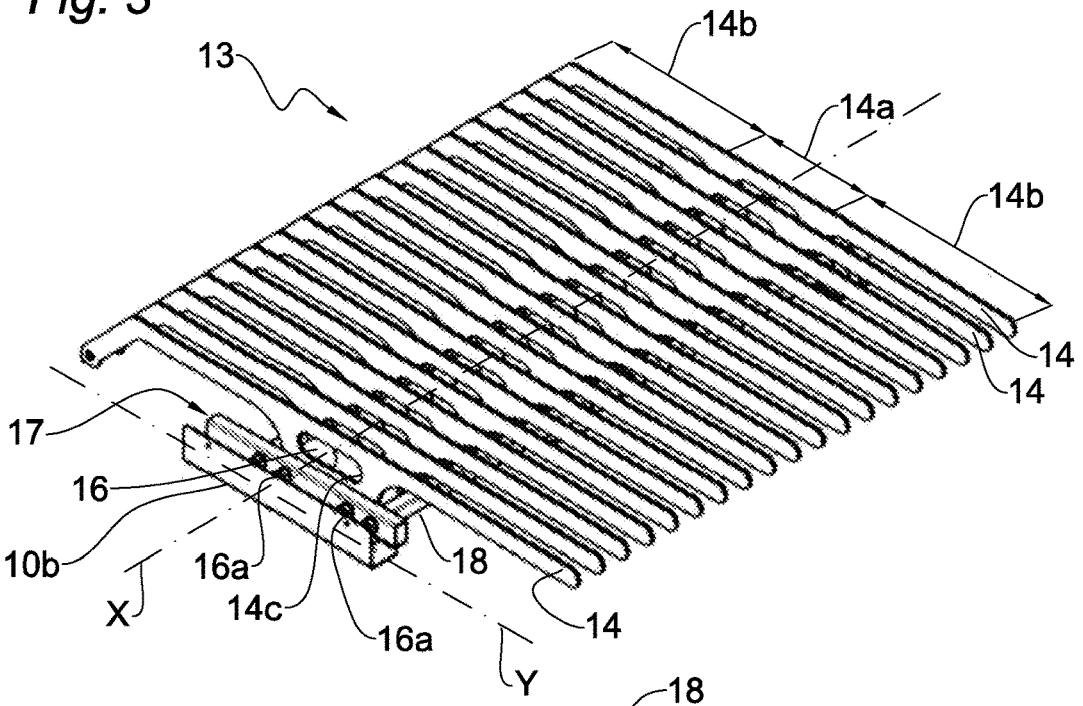
FIGS. 3 and 4 are enlarged scale and perspective views, respectively, from above and from below of a component of the emptying unit shown in FIG. 2.
Figure 4:
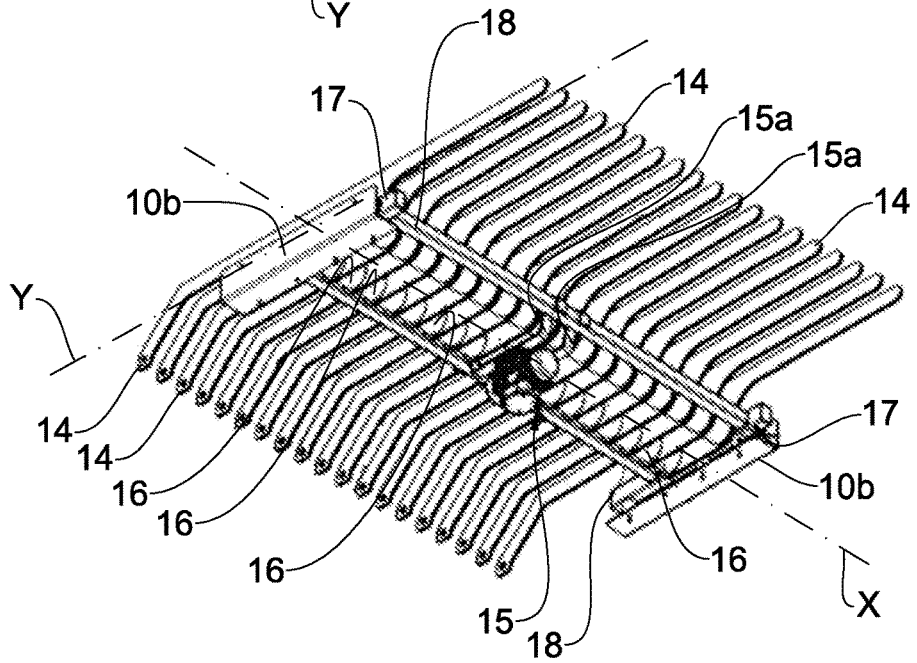

With reference to the figures attached, reference number 1 identifies, overall, an apparatus for emptying bags 2 containing plastic granules.

The apparatus 1 can be slaved to a plant for transformation of plastic material into granules, such as, for example, a molding or extrusion plant.

The loose material contained in the bags 2, however, as well as its intended purpose, may differ from those described here by way of example.

The apparatus 1 comprises, in all, an unloading unit 3 designed or configured to unload the bags 2 from a pallet 4 and an emptying unit 10 adjacent the unloading unit and designed or configured to slit and empty the bags 2 coming from the unloading unit 3.

The apparatus 1 comprises a movement device 5 that can hook the bags 2 at the unloading unit 3 and move them along an advancement direction X towards the emptying unit 10.

In the preferred form described here, the movement device 5 comprises a mobile trolley 6 that can move along guides 7, which define the advancement direction X, and a plurality of hooks mounted on the mobile trolley 6 to hook the bags 2.

The emptying unit 10 comprises a support frame 10*a* onto which a cutting member 11 is mounted, designed or configured to cut the bags 2. The cutting member 11 is made up of a plurality of blades 12 oriented parallel to the advancement direction X.

The blades 12 are positioned in a row, alongside each other, along a transverse direction Y, substantially perpendicular to the advancement direction X, at regular distances from each other, defining a pitch of approximately 50-100 mm.

The blades 12 are circular and rotate about a single rotation axis, parallel to the transverse direction Y, driven by a motor 12*a*.

Immediately downstream of the blades 12, there is a support grid 13, made up of a plurality of rods 14 arranged in a row, next to each other, and all substantially extending along the advancement direction X.

The support grid 13 defines a plane parallel to the directions X and Y, set at a height such as to be a few centimeters lower than the upper row of the blades 12.

The rods 14 are parallel and spaced regularly, with a pitch similar to the pitch between the blades 12.

Each rod 14 is also positioned on the support grid 13 in such a way as to be substantially aligned with a respective blade 12.

In the embodiment described here with reference to FIGS. 1 to 4, the rods 14 are vibrating rods and are therefore vibrated by a motovibrator 15. For example, the motovibrator 15 is a motor that causes an eccentric mass to rotate at a speed of approximately 3,000 rpm.

Each rod 14 has an elongated conformation along the advancement direction X, covering the entire length of the support grid 13, of approximately 100-150 cm, a thickness, understood as the dimension parallel to the transverse direction Y, of approximately 3-10 mm and a height, understood as the dimension perpendicular to the plane defined by the directions X and Y, of approximately 30-100 mm.

On each rod 14, a median zone 14*a* is defined, which is substantially central and extends for approximately 20% of the length of the rod 14 and two end regions 14*b*, extending in opposite directions from the median zone 14*a*.

The rods 14 are held together by a pair of support bars, for example threaded bars, extending along the transverse direction Y and which pass through the rods 14 at respective holes made in the median zone 14*a* of each of the rods 14.

By this configuration, the rods 14 are connected to each other at their median zone 14*a*, leaving the opposed end regions 14*b* free to oscillate.

The end portions of the end regions 14*b* facing the cutting member 11 are, for example, inclined downwards, so as to help the bags 2 coming from the blades 12 to rest on the support grid 13.

Each rod 14, at its respective median zone 14*a* has a greater height than the end regions 14*b* and, for example, a hole 14*c* is created in the rod 14 to reduce its weight.

A spacer 16 made of resilient material, through which one of the two support bars also passes, is positioned between each pair of adjacent rods 14.

The rods 14 and spacers 16 are strictly tightened together thanks to the action of respective threaded nuts 16*a* provided at the opposing ends of the support bars.

The ends of the support bars are, in turn, fixed to a pair of heads 17, arranged externally and to the side of the rods 14.

Each head 17 comprises a tubular element extending parallel to the advancement direction X and fixed to a bracket 10*b* of the support frame 10*a*, with the interpositioning of suitable anti-vibration elements, so as to ensure that the vibrations caused by the motovibrator 15 remain confined to the support grid 13 and are not conveyed to the whole of the emptying unit 10.

A pair of crosspieces 18 extend between the heads 17 parallel to the transverse direction Y and are integral with the heads 17 jointly.

The crosspieces 18 are positioned below the rods 14, immediately alongside their median region 14*a*. Centrally and below the crosspieces 18, the motovibrator 15 is also fixed, by a pair of brackets 15*a* welded to the crosspieces 18.

The apparatus 1 also comprises a pressurized gas circuit 20 designed or configured to blow a jet of gas towards the bags 2, once cut by the blades 12.

The pressurized gas is typically compressed air, but may be any other type of gas.

The pressurized gas circuit 20 can be independent, with a compressor and one or more storage tanks, or it can be connected to an external compressed air line.

The pressurized gas circuit 20 comprises a plurality of nozzles 21, which are, preferably, arranged along the opposed sides of the support grid 13, for example three per side. More specifically, the nozzles 21 are fixed on the sides 10*c* of the support frame 10*a*, situated laterally to the support grid 13 and lower down than the support surface defined by the support grid 13.

The nozzles 21 are oriented towards the support grid 13, substantially perpendicular to the advancement direction X.

Each nozzle 21 in any case has an adjustable head, so as to ensure that the direction of the jet of gas can be adjusted at will.

Beneath the support grid 13, there is also a discharge hopper 30 designed or configured to collect up any material that has fallen from the slit bags 2.

The apparatus 1 operates as follows.

The bags 2 containing the loose material are conveyed along the advancement direction X by the movement device 5 towards the cutting member 11, at which the bags 2 are cut deeply by the blades 12, which are rotated by the motor 12*a*.

The bags 2 cut longitudinally by the blades 12 remain hooked on the movement device 5, which drives them onto the support grid 13, resting on the rods 14.

Here, much of the loose material contained in the bags 2 falls, through the support grid 13, into the discharge hopper 30 below.

As the slit bags 2 pass over the support grid 13, the pressurized gas circuit 20 is activated, so that the nozzles 21 emit jets of gas of a suitable flow and duration towards the shreds of the bags 2.

The jet of gas may be continuous or, more preferably, intermittent.

More specifically, the gas may be emitted alternately first from the nozzles 21 on one side of the support grid 13 and then from the nozzles 21 on the other side of the support grid 13, so as to shake the shreds of the bags 2, first on one side and then on the other side.

In this manner, the jets of gas shake the shreds of the slit bags, causing any material that may have become caught in the folds of the bags 2, to fall.

Moreover, as the bags 2 are moved on the support grid 13, the motovibrator 15 is activated.

The vibration movement generated by the motovibrator 15 is conveyed directly, through the crosspieces 18 and heads 17 to the median zone 14*a* of the rods 14 positioned to the sides of the support grid 13 in direct contact with the heads 17. The vibration is therefore conveyed to the other rods 14 by the support bars and spacers 16, again at the respective median zones 14*a*.

On each rod 14, the vibratory motion is conveyed from the median zone 14*a* to the end regions 14*b*, which, as they are unrestricted, oscillate at a different amplitude and phase from the median zone 14*a*, according to the geometric and physical characteristics of the rods 14.

In general, the amplitude of the oscillations of the end regions 14*b* is greater, thereby ensuring greater shaking of the slit bags 2.

Moreover, each rod 14 can vibrate differently from the others, due to the provision of the spacers 16 made of resilient material, which convey the vibration between adjacent rods 14, varying some characteristics of the vibration (phase and amplitude).

This variation causes the movement of each rod 14 to differ in its various regions and to differ from the other rods 14, shaking the shreds of the slit bags 2 with an overall uneven movement, obtaining a more effective emptying.

The apparatus 1 according to the invention therefore allows a high degree of emptying of the bags 2, with recovery of most of the loose material.

Moreover, the apparatus emptying system can be easily and extensively customized, adjusting the flow, direction, and duration of each individual jet.

Figure 5:
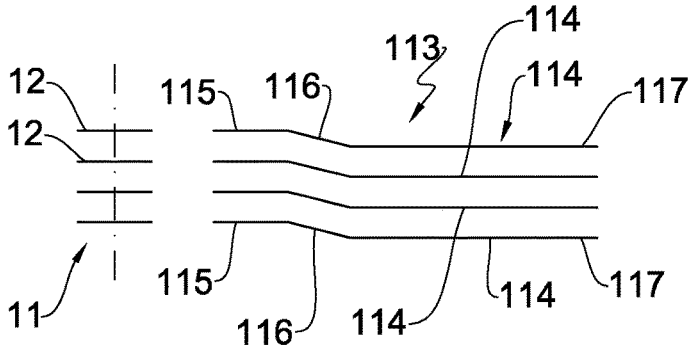
FIG. 5 is an enlarged scale and plan view from above of a detail of a variant embodiment of the component shown in FIGS. 3 and 4.

FIG. 5 shows a variant embodiment of the support grid 13, indicated overall as 113, in which the rods are identified as 114.

In this variant embodiment, the rods 114 do not extend in a straight line along the advancement direction X, like the rods 14 of the preferred example described previously; rather they have lateral spacing.

More specifically, on each rod 114, starting from the cutting member 11, three consecutive portions are identified, indicated as 115, 116, and 117.

The first portion 115 is approximately 10 cm long and substantially parallel to the advancement direction X; the second portion 116 is approximately 15 cm long and is inclined with respect to the advancement direction X by approximately 250; finally, the third portions 117 is substantially parallel to the advancement direction X and extends as far as the end of the support grid 13.

In this case, the emptying phase of the bags 2 is assisted by the fact that the shreds of the bags 2 conveyed between the rods 114 are upturned as a result of the lateral spacing due to the inclination of the second portions 116.

The rods 114 may also vibrate, in a similar manner to the rods 14.

This invention thus solves the above-described problem and yields numerous other advantages.

Although illustrated and described above with reference to certain specific embodiments, the present disclosure is nevertheless not intended to be limited to the details shown. Rather, various modifications may be made in the details within the scope and range of equivalents of the claims and without departing from the spirit of the disclosure.

The invention claimed is:

1. An apparatus for emptying bags containing loose material, comprising:

a cutting member for cutting the bags;

a support grid including a row of rods arranged downstream of the cutting member with respect to an advancement direction of the bags and on which the bags are carried once they have been cut;

a motovibrator associated with the rods and configured to vibrate the rods and aid the process of emptying the bags; and a resilient spacer interposed between each pair of adjacent rods.

2. The apparatus according to claim 1, wherein the rods each have opposite end regions and are free in at least one end region.

3. The apparatus according to claim 2, wherein the rods are free at both opposite end regions.

4. The apparatus according to claim 1, wherein the rods each have a median zone and are strictly tightened in the median zone.

5. The apparatus according to claim 4, further comprising a pair of heads and wherein the rods are held between the pair of heads connected to the median zone.

6. The apparatus according to claim 5, wherein the motovibrator is connected to the pair of heads.

7. The apparatus according to claim 1, wherein the rods each have a median zone and wherein the motovibrator vibrates the rods in the median zone.

8. The apparatus according to claim 1, wherein the rods substantially extend along the advancement direction.

9. The apparatus according to claim 1, wherein the rods comprise a first portion, a second portion, and a third portion, the second portion inclined with respect to the advancement direction and between the first and third portions that are substantially parallel to the advancement direction.

10. The apparatus according to claim 1, further comprising a pressurized gas circuit configured to blow a jet of gas towards the bags once the bags are cut by the cutting member.

11. The apparatus according to claim 10, wherein the support grid has opposite sides and the pressurized gas circuit has a plurality of nozzles arranged along the opposed sides of the support grid and oriented towards the support grid, substantially perpendicular to the advancement direction, with each nozzle having an adjustable head allowing adjustment of the direction of the jet of gas.

12. An apparatus for emptying bags containing loose material, comprising:

a cutting member for cutting the bags;

a support grid including a row of rods arranged downstream of the cutting member with respect to an advancement direction of the bags and on which the bags are carried once they have been cut, wherein the rods each have a median zone and opposite end regions, are free in at least one end region, and are strictly tightened in the median zone;

a motovibrator associated with the rods and configured to vibrate the rods in the median zone of the rods and aid the process of emptying the bags; and a resilient spacer interposed between each pair of adjacent rods.

13. The apparatus according to claim 12, wherein the rods are free at both opposite end regions.

14. The apparatus according to claim 12, further comprising a pair of heads and wherein the rods are held between the pair of heads connected to the median zone.

15. The apparatus according to claim 14, wherein the motovibrator is connected to the pair of heads.

16. The apparatus according to claim 12, wherein the rods substantially extend along the advancement direction.

17. The apparatus according to claim 12, wherein the rods comprise a first portion, a second portion, and a third portion, the second portion inclined with respect to the advancement direction and between the first and third portions that are substantially parallel to the advancement direction.

18. An apparatus for emptying bags containing loose material, comprising:

a cutting member for cutting the bags;

a support grid including a pair of heads and a row of rods arranged downstream of the cutting member with respect to an advancement direction of the bags and on which the bags are carried once they have been cut, wherein the rods each have a median zone and opposite end regions, are free at both opposite end regions, and are strictly connected to and held between the pair of heads in the median zone;

a motovibrator connected to the pair of heads, associated with the rods, and configured to vibrate the rods in the median zone of the rods and aid the process of emptying the bags; and a resilient spacer interposed between each pair of adjacent rods.

19. The apparatus according to claim 18, wherein the rods substantially extend along the advancement direction.

20. The apparatus according to claim 18, wherein the rods comprise a first portion, a second portion, and a third portion, the second portion inclined with respect to the advancement direction and between the first and third portions that are substantially parallel to the advancement direction.

* * * * *